US006859181B2

(12) United States Patent
Colburn et al.

(10) Patent No.: US 6,859,181 B2
(45) Date of Patent: Feb. 22, 2005

(54) INTEGRATED SPIRAL AND TOP-LOADED MONOPOLE ANTENNA

(75) Inventors: Joseph S. Colburn, Malibu, CA (US); Jonathan J. Lynch, Oxnard, CA (US)

(73) Assignee: General Motors Corporation, Detroit, MI (US)

( * ) Notice: Subject to any disclaimer, the term of this patent is extended or adjusted under 35 U.S.C. 154(b) by 52 days.

(21) Appl. No.: 10/602,786

(22) Filed: Jun. 24, 2003

(65) Prior Publication Data

US 2004/0263406 A1 Dec. 30, 2004

(51) Int. Cl.[7] ..... H01Q 21/00
(52) U.S. Cl. ..... 343/725; 343/895; 343/713
(58) Field of Search ..... 343/725, 895, 343/713, 878, 872

(56) References Cited

U.S. PATENT DOCUMENTS 3,838,429 A * 9/1974 Reggia ..... 343/750
4,030,100 A * 6/1977 Perrotti ..... 343/709
5,257,032 A * 10/1993 Diamond et al. ..... 343/730
5,457,469 A * 10/1995 Diamond et al. ..... 343/730

* cited by examiner

*Primary Examiner*—Hoang V. Nguyen
(74) *Attorney, Agent, or Firm*—Christopher DeVries

(57) ABSTRACT

A low-profile antenna provides dual simultaneous operation. A first antenna has a circular polarization radiation pattern. A monopole antenna includes a hollow tube and is top-loaded by locating a disk on top of the hollow tube. A support structure positions the monopole antenna between the first antenna and a ground plane. The first antenna is a four arm spiral antenna. The four arm spiral antenna and monopole antenna are each fed by a cable with a first conductor and a second conductor. The radiation pattern of the four arm spiral antenna is maximum at forty-five degrees above the horizon and is null toward the horizon. The cable excites the monopole antenna with respect to the ground plane to transmit/receive vertical polarized signals. The radiation pattern of the monopole antenna is maximum towards the horizon. The first antenna and the monopole antenna operate simultaneously.

21 Claims, 4 Drawing Sheets

INTEGRATED SPIRAL AND TOP-LOADED MONOPOLE ANTENNA

FIELD OF THE INVENTION

The present invention relates to low-profile antennas, and more particularly to multiple function low-profile antennas.

BACKGROUND OF THE INVENTION

Low-profile antennas are typically used in vehicles. The low-profile antennas are commonly mounted on an exterior of the vehicle. For aesthetic reasons, the low-profile antennas are preferably small in size. Various vehicle systems may require an antenna such as cellular phones, satellite radio, terrestrial radio, and/or global positioning systems (GPS). Providing several antennas on a vehicle is costly and aesthetically displeasing.

Geosynchronous satellite communication systems require the transmission and/or reception of circular polarized signals. Terrestrial communication systems require the transmission and/or reception of vertical polarized signals. Often these signals need to be communicated simultaneously.

A Direct Broadcast Satellite (DBS) radio system broadcasts radio frequency (RF) signals from a satellite to a receiver in a vehicle. The RF signals are also received by terrestrial repeaters that rebroadcast the RF signals. The terrestrial repeaters fill in gaps in the satellite transmission that may occur when the path between the vehicle and satellite is obstructed.

The bandwidth of DBS radio systems is typically narrow (12 MHz, for example). This is due to the low power available from satellites. Because of this, an antenna used to receive DBS radio signals will generally require a bandwidth at least as wide as the signals of either the satellite broadcaster or terrestrial repeater.

An integrated antenna described in "Low Profile, Dual Polarized/Pattern Antenna", Ser. No. 60/388,097, filed Jun. 10, 2002, is low-profile and dual polarized. A spiral antenna radiates circular polarization. A spiral feed coaxial line, used to feed the spiral antenna, acts as a monopole antenna to radiate vertical polarization. A feed circuit is required to make the spiral feed coaxial line act as a monopole antenna. When operated at the desired frequency, the length of the monopole is electrically large. This requires the antenna to operate at a higher order resonance, which results in a narrow bandwidth of frequencies.

Current antennas, such as a quadrafiler helix antenna, can transmit or receive circular and vertical polarized signals. However, these antennas are large and not aerodynamic or aesthetically pleasing when mounted on the exterior of the vehicle.

SUMMARY OF THE INVENTION

A low-profile antenna according to the present invention provides dual simultaneous operation. A first antenna has a circular polarization radiation pattern. A monopole antenna includes a hollow tube. A support structure positions the first antenna at a first distance from a ground plane and positions the monopole antenna between the first antenna and the ground plane.

In other features, the monopole antenna is top-loaded and is formed by locating a disk on top of the hollow tube. The first antenna is a spiral antenna with a plurality of arms formed in a material. The spiral antenna is a four arm spiral antenna and adjacent arms of the four arm spiral antenna are excited with a phase shift of 180 degrees to transmit/receive circular polarized signals. The four arm spiral antenna is fed by a cable with a first conductor and a second conductor. The first conductor connects to a first pair of nonadjacent arms of the four arm spiral antenna and the second conductor connects to a second pair of nonadjacent arms of the four arm spiral antenna. The cable passes through the hollow tube without making electrical contact with the hollow tube. The four arm spiral antenna produces a radiation pattern that is maximum at forty-five degrees above the horizon and that is null toward the horizon. The radiation pattern is symmetric about a center point of the first antenna.

In still other features of the invention, the monopole antenna is fed by a cable with a first conductor and a second conductor. The first conductor is connected to the hollow tube and the second conductor is connected to the ground plane. The cable excites the monopole antenna with respect to the ground plane to transmit/receive vertical polarized signals. The monopole antenna produces a radiation pattern that is maximum towards the horizon. The first antenna and the monopole antenna operate simultaneously.

In yet other features, the first antenna is fed by a first coaxial cable having an inner conductor and an outer conductor and the monopole antenna is fed by a second coaxial cable having an inner conductor and an outer conductor. An enclosure is located below the hollow tube that contains an additional circuit for the antenna. The ground plane is a metal surface of a vehicle. The disk reduces a length of the monopole antenna required for a desired frequency of the monopole antenna to be at a fundamental resonance level. The disk increases a bandwidth of frequencies of the fundamental resonance level for the top-loaded monopole antenna. The support structure is a housing including a dielectric material. The dielectric material includes Lexan polycarbonate and reduces a required length of the monopole antenna. The first antenna and the monopole antenna operate in a Direct Broadcast Satellite (DBS) radio system. The material is a low loss dielectric.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
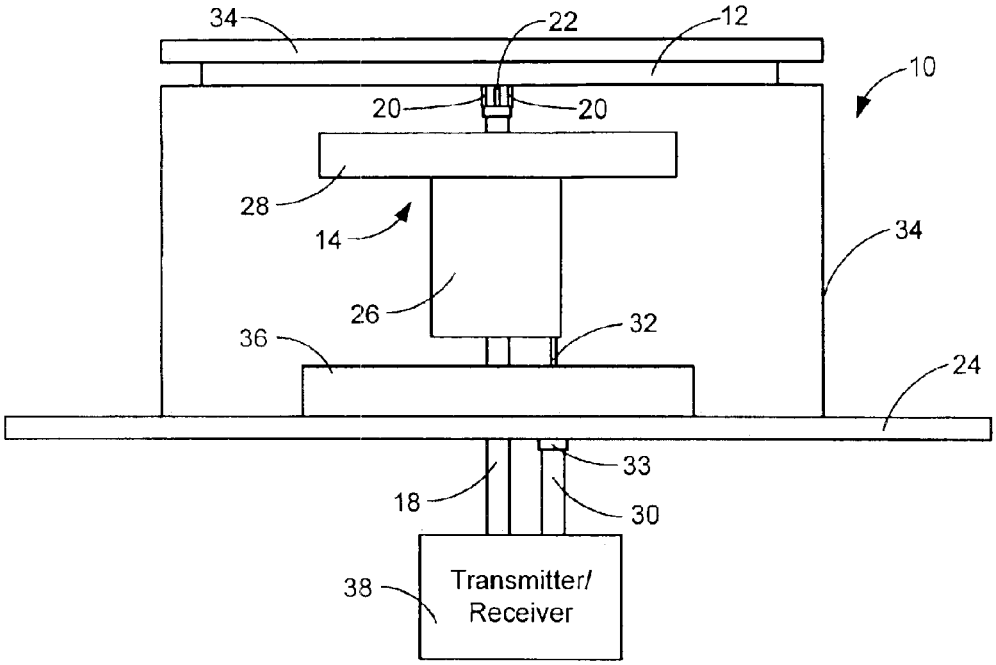
FIG. 1 is a side cross-sectional view of an integrated antenna according to the present invention.

The following description of the preferred embodiment(s) is merely exemplary in nature and is in no way intended to limit the invention, its application, or uses. For purposes of clarity, the same reference numbers will be used in the drawings to identify similar elements.

Figure 2:
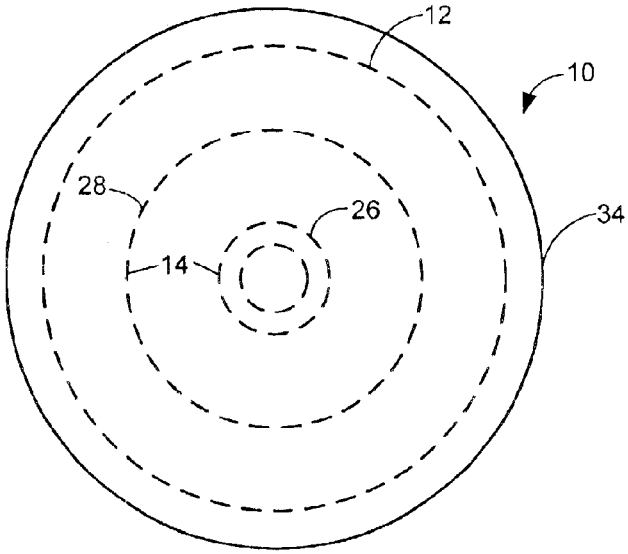
FIG. 2 is a plan view of the integrated antenna of FIG. 1.
Figure 3:
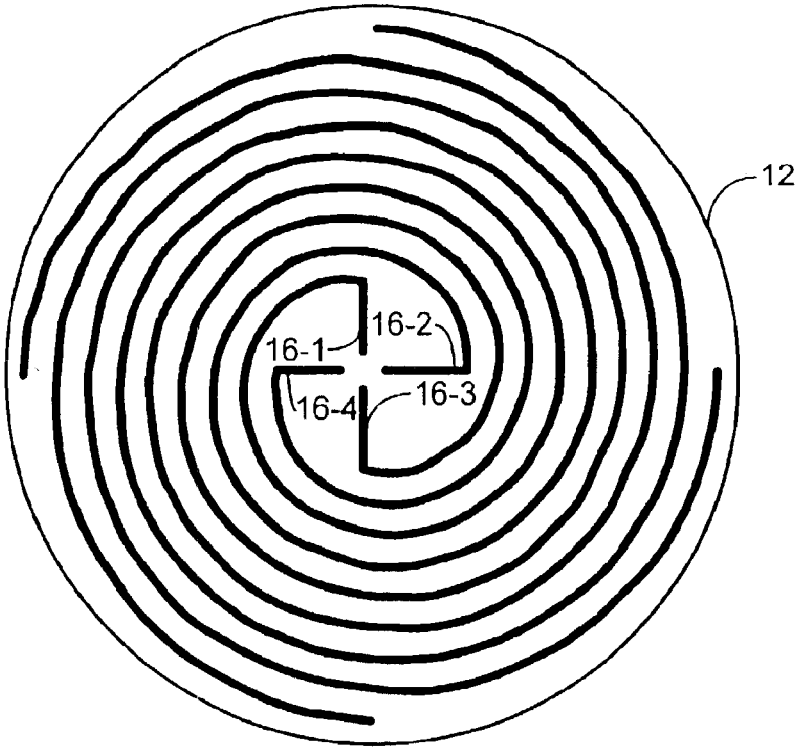
FIG. 3 illustrates an exemplary spiral antenna used to radiate circular polarization.

Referring now to FIGS. 1–3, an antenna 10 includes a spiral antenna 12 and a top-loaded monopole antenna 14 that are integrated for independent or simultaneous operation. In FIG. 3, an exemplary embodiment of the spiral antenna 12 is shown to include a spiral structure with independent arms 16-1, 16-2, 16-3, and 16-4 that spiral and converge in a middle of the spiral antenna 12.

The spiral antenna 12 is fed by a first cable 18 with a first conductor 20 and a second conductor 22. The first conductor 20 is connected to a first pair of nonadjacent arms (16-1 and 16-3) or (16-2 and 16-4) of the spiral antenna 12. The second conductor 22 is connected to a second pair of nonadjacent arms (16-2 and 16-4) or (16-1 and 16-3) of the spiral antenna 12.

The spiral antenna 12 typically operates in one of three modes. The arms 16 of the spiral antenna 12 are excited by a phase shift between adjacent arms to generate the different modes. In mode one, a 360/n degree phase shift is applied between adjacent arms, where n is the number of arms in the spiral. In mode two, a 720/n phase shift is applied between adjacent arms. In mode three, a 1080/n degree phase shift is applied between adjacent arms. The different modes generate different radiation patterns.

The spiral antenna 12 of the present invention preferably operates in mode two, which radiates circular polarization. The spiral antenna 12 has a radiation pattern that is maximum at forty-five degrees above the horizon. The radiation pattern is also null along the antenna axis. Typically, power toward the horizon is at least 10 dB less than the power at forty-five degrees above the horizon. This radiation pattern is ideal for mobile terminals located in the continental US that are required to view geosynchronous satellites.

To excite mode two in the spiral antenna 12 having four arms, a (720/4)=180 degree phase shift is applied between adjacent arms (16-1 and 16-2), (16-2 and 16-3), (16-3 and 16-4), and/or (16-4 and 16-1). This is done with the first cable 18 by feeding the first pair of nonadjacent arms (16-1 and 16-3) or (16-2 and 16-4) with the first conductor 20. The second pair of nonadjacent arms (16-2 and 16-4) or (16-1 and 16-3) are fed by the second conductor 22.

For optimization of the mode two radiation pattern, the spiral antenna 12 is preferably mounted above a ground plane 24. For example, the spiral antenna 12 may be mounted approximately one inch above the ground plane 24. The spiral antenna 12 is also preferably formed in a low loss dielectric material such as a substrate suitable for microwave transmission. While the spiral antenna 12 is shown with four arms, a spiral antenna with a different number of arms can also be used. Alternatively, other antennas that can radiate circular polarized signals can be used. However, other types of circular polarization antennas would increase the size of the antenna 10. When the spiral antenna 12 has a different number of arms, the spiral antenna 12 requires a different phase shift between adjacent arms to produce circular polarization. This also affects the hardware used to feed the spiral antenna. A different number of cables or conductors would be needed to satisfy the phase shift angle required between adjacent arms of the spiral.

The top-loaded monopole antenna 14 is located below the spiral antenna 12. The top-loaded monopole antenna 14 includes a hollow tube 26. A disk 28 is located at one end of the hollow tube 26. The top-loaded monopole antenna 14 is fed by a second cable 30 with a first conductor 32 and a second conductor 33. The first conductor 32 is connected to the hollow tube 26. The second conductor 33 is connected to the ground plane 24. The first cable 18 passes through the top-loaded monopole antenna 14 without making electrical contact with the top-loaded monopole antenna 14. The second cable 30 does not interfere electrically with the first cable 18.

The radiation pattern produced by the top-loaded monopole antenna 14 is ideal for terrestrial communication. The top-loaded monopole antenna 14 operates by exciting the hollow tube 26 and the disk 28 with respect to the ground plane 24. The top-loaded monopole antenna 14 produces a radiation pattern that is maximum towards the horizon. The first cable 18 and the second cable 30 are preferably coaxial cables. If the second cable 30 were a coaxial cable, the inner conductor would be the first conductor 32 of the second cable 30 and the outer conductor would be the second conductor 33 of the second cable 30.

While the disk 28 is optional, the disk 28 reduces the length of the top-loaded monopole antenna 14 required for the desired frequency of the top-loaded monopole antenna 14 to be at the fundamental resonance level. This maintains a low profile for the antenna 10. The disk 28 also increases the bandwidth of frequencies at the fundamental resonance level for the top-loaded monopole antenna 14. Making the hollow tube 26 thicker will also accomplish this because a larger current path is created without making the top-loaded monopole antenna 14 longer. Although the bandwidth of satellite radio systems is typically narrow, it is desirable to have as wide an operation bandwidth as possible to compensate for manufacturing variances.

A dielectric housing 34 positions the spiral antenna 12 a distance above the ground plane 24 and the top-loaded monopole antenna 14 below the spiral antenna 12. The dielectric housing 34 is preferably Lexan polycarbonate. While the dielectric housing 34 is shown, another support structure can be used to position the antenna 10. The dielectric housing 34 also protects the antenna 10 from the environment and keeps the required size of the antenna 10 smaller. Having material with a high dielectric constant next to the antenna 10 has the effect of making the antenna 10 electrically larger, and reduces the size required for the antenna 10 to function as desired. However, too high a dielectric constant can produce undesirable effects in the antenna 10. Lexan polycarbonate has a dielectric constant between 2 and 2.7. For example, in an exemplary embodiment the Lexan polycarbonate housing reduced the required diameter of the spiral antenna 12 from 4 inches to 2.5 inches.

An enclosure 36 located at the bottom of the dielectric housing 34 provides space for additional circuitry required for system operation, such as amplifiers and filters. However, the enclosure 36 is not necessary for operation of the antenna 10. The antenna 10 is preferably located on top of a metal plane, such as a car roof, which would act as the ground plane 24 for the spiral antenna 12 and the top-loaded monopole antenna 14.

In an exemplary embodiment, the antenna 10 is used in a Direct Broadcast Satellite (DBS) radio system. For example, the antenna may operate in the XM Satellite Radio System, which operates in the frequency band of 2.3325 GHz to 2.345 GHz. The dielectric housing 34 includes Lexan pblycarbonate, is 2.9 inches in diameter, and 1 inch in height. The spiral antenna 12 is fabricated on 20 mil thick Rogers R03003 substrate material and is 2.5 inches in diameter. The hollow tube 26 is 0.7 inches in height and 0.4 inches in diameter. The center hole of the hollow tube 26 is 0.37 inches. The disk 28 has a 1 inch diameter and pressure fits on top of the hollow tube 26.

The antenna 10 is fed by the first cable 18 and the second cable 30. The first cable 18 and the second cable 30 are routed to a radio receiver 38. A transceiver can be used if the antenna 10 is used for both receiving and transmitting signals.

Figure 4:
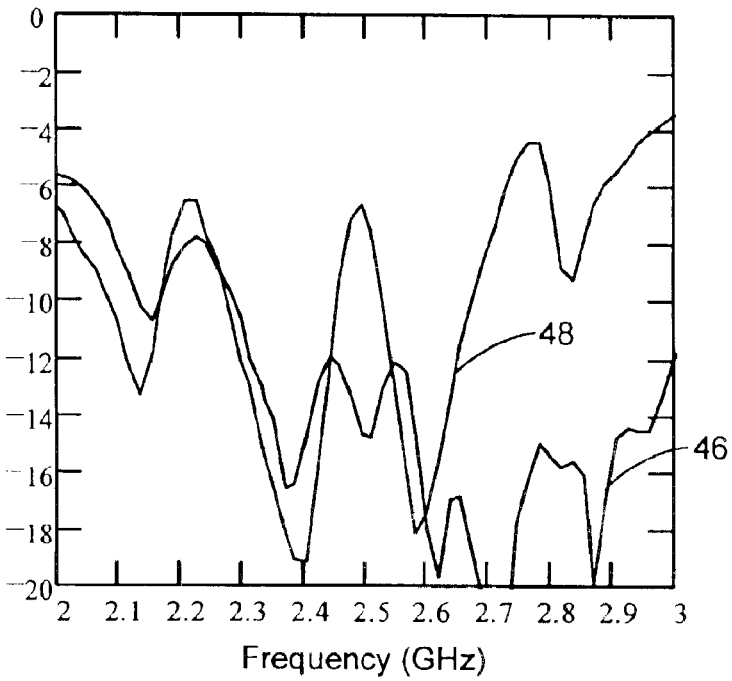
FIG. 4 is a graph showing the input reflection coefficient of the top-loaded monopole antenna of FIG. 1 and the spiral antenna of FIG. 3 as a function of frequency.

Referring now to FIG. 4, the input reflection coefficient of the top-loaded monopole antenna 14 and the spiral antenna 12 is shown as a function of frequency. The reflection coefficient is the ratio of energy that is reflected back from an antenna compared to the amount of energy that is delivered to the antenna. A low value is desired, and a figure less that −10 dB is suitable. In the frequency band of interest (2.3325 to 2.345 GHz), the return loss for both the spiral antenna 12, indicated at 46, and the top-loaded monopole antenna 14, indicated at 48, is less than −10 dB.

Figure 5:
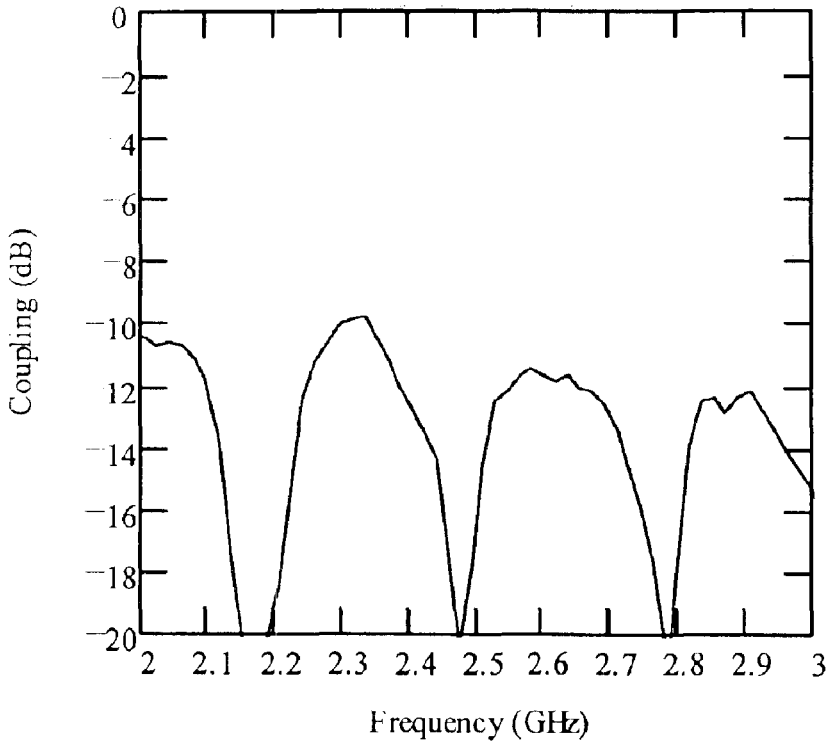
FIG. 5 is a graph showing coupling between the top-loaded monopole antenna of FIG. 1 and the spiral antenna of FIG. 3 as a function of frequency.

Referring now to FIG. 5, coupling between the top-loaded monopole antenna 14 and the spiral antenna 12 is shown as a function of frequency. The measurement is made by connecting the first cable 18 and the second cable 30 to a two-port network analyzer. The coupling coefficient was measured, which is the ratio of energy that is output by one of the antennas to the energy delivered to the other antenna. For example, if energy was input to the monopole antenna feed, the amount of energy that was output by the spiral antenna feed would be measured and compared to energy sent to the monopole. In the frequency band of interest (2.3325 to 2.345 GHz) the coupling is less than −10 dB.

Figure 6:
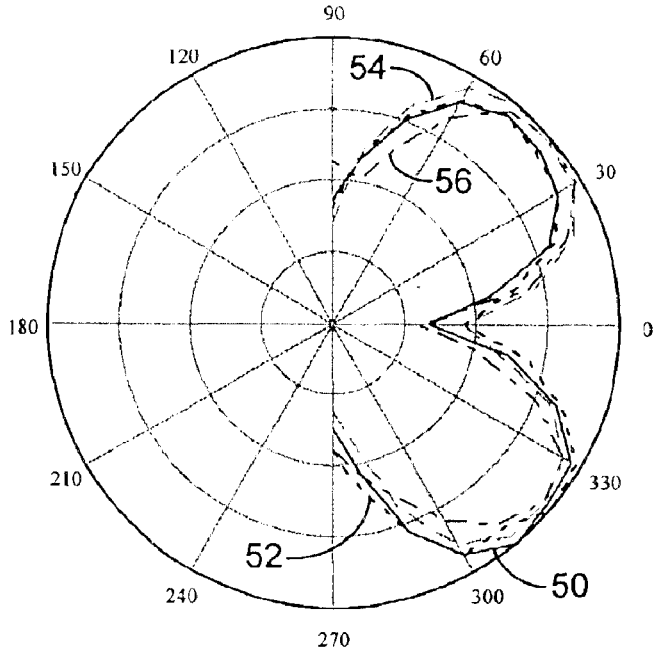
FIG. 6 is a plot illustrating the elevation gain of the spiral antenna of FIG. 3.
Figure 7:
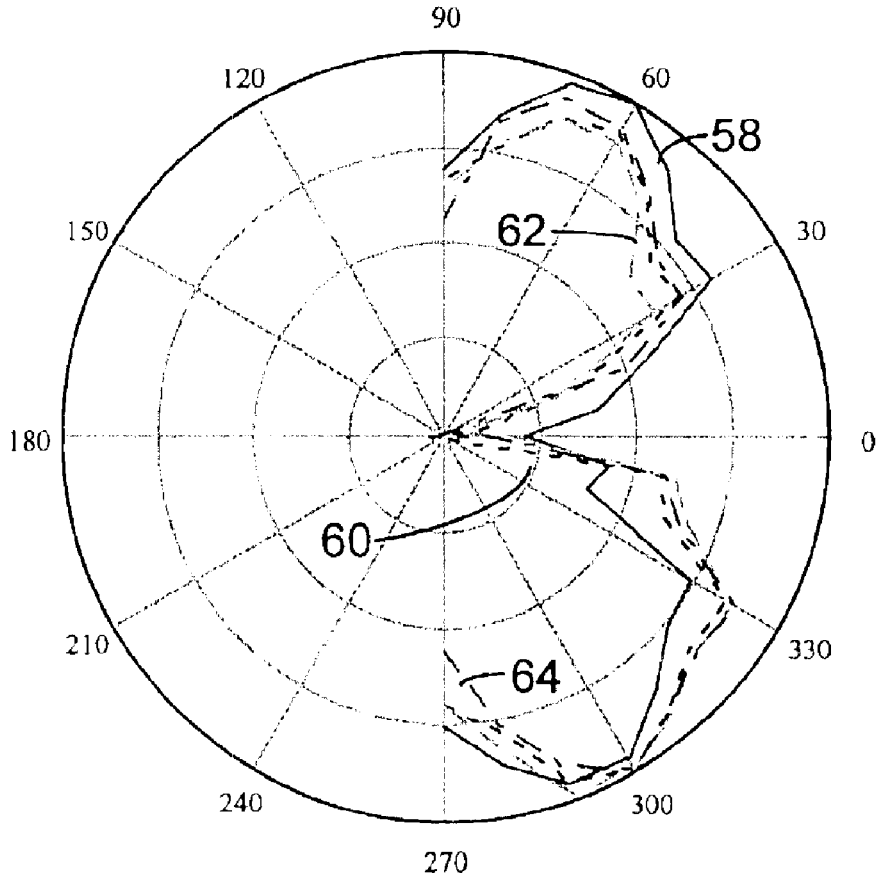
FIG. 7 is a plot illustrating the elevation gain of the top-loaded monopole antenna of FIG. 1.

Referring now to FIGS. 6 and 7, the measured elevation gain of the spiral antenna 12 (FIG. 6) and the top-loaded monopole antenna (FIG. 7) is shown at 2.338 GHz in different phi cuts. In FIG. 6, the gain of the left hand circular polarization component is plotted and in FIG. 7 the vertical polarization gain is plotted. The phi cuts represent the radiation pattern existing in different vertical planes. The vertical planes are situated at different angles and are symmetric about the center of the spiral antenna 12 and the top-loaded monopole antenna 14. In FIG. 6, the gain of the spiral antenna 12 is greatest at approximately forty-five degrees above the horizon. The circular polarization is ideal for geosynchronous satellite communication. A phi cut of 0 degrees is indicated at 50, 45 degrees is indicated at 52, 90 degrees is indicated at 54, and 135 degrees is indicated at 56. In FIG. 7, the measured vertically polarized elevation gain of the top-loaded monopole antenna 14 is ideal for terrestrial communications. A phi cut of 0 degrees is indicated at 58, 45 degrees is indicated at 60, 90 degrees is indicated at 62, and 135 degrees is indicated at 64. In FIGS. 6 and 7, the antenna 10 is mounted on a 24 inch by 24 inch ground plane 24. Theta of 0 degrees is a direction perpendicular to the surface of the ground plane 24. The peak of each curve is nominalized to 0 dB and each division represents 5 dB.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A low-profile antenna that provides dual simultaneous operation, comprising:

a first antenna having a circular polarization radiation pattern;

a monopole antenna including a hollow tube;

a ground plane; and a support structure that positions said first antenna at a first distance from said ground plane and that positions said monopole antenna between said first antenna and said ground plane.

2. The antenna of claim 1 wherein said monopole antenna is top-loaded and is formed by locating a disk on top of said hollow tube.

3. The antenna of claim 2 wherein said disk reduces a length of said monopole antenna required for a desired frequency of said monopole antenna to be at a fundamental resonance level.

4. The antenna of claim 3 wherein said disk increases a bandwidth of frequencies of said fundamental resonance level for said top-loaded monopole antenna.

5. The antenna of claim 1 wherein said first antenna is a spiral antenna with a plurality of arms formed in a material.

6. The antenna of claim 5 wherein said spiral antenna is a four arm spiral antenna and adjacent arms of said four arm spiral antenna are excited with a phase shift of 180 degrees to transmit/receive circular polarized signals.

7. The antenna of claim 6 wherein said four arm spiral antenna is fed by a cable with a first conductor and a second conductor, wherein said first conductor connects to a first pair of nonadjacent arms of said four arm spiral antenna and said second conductor connects to a second pair of nonadjacent arms of said four arm spiral antenna.

8. The antenna of claim 7 wherein said cable passes through said hollow tube without making electrical contact with said hollow tube.

9. The antenna of claim 6 wherein said four arm spiral antenna produces a radiation pattern that is maximum at forty-five degrees above the horizon and that is null toward the horizon.

10. The antenna of claim 9 wherein said radiation pattern is symmetric about a center point of said first antenna.

11. The antenna of claim 5 wherein said material is a low loss dielectric.

12. The antenna of claim 1 wherein said monopole antenna is fed by a cable with a first conductor and a second conductor, wherein said first conductor is connected to said hollow tube and said second conductor is connected to said ground plane.

13. The antenna of claim 12 wherein said cable excites said monopole antenna with respect to said ground plane to transmit/receive vertical polarized signals.

14. The antenna of claim 13 wherein said monopole antenna produces a radiation pattern that is maximum towards the horizon.

15. The antenna of claim 1 wherein said first antenna and said monopole antenna operate simultaneously.

16. The antenna of claim 1 wherein said first antenna is fed by a first coaxial cable having an inner conductor and an outer conductor and said monopole antenna is fed by a second coaxial cable having an inner conductor and an outer conductor.

17. The antenna of claim 1 further comprising an enclosure located below said hollow tube that contains an additional circuit for the antenna.

18. The antenna of claim 1 wherein said ground plane is a metal surface of a vehicle.

19. The antenna of claim 1 wherein said support structure is a housing including a dielectric material.

20. The antenna of claim 19 wherein said dielectric material includes Lexan polycarbonate and reduces a required length of said monopole antenna.

21. The antenna of claim 1 wherein said first antenna and said monopole antenna operate in a Direct Broadcast Satellite (DBS) radio system.

* * * * *